US011763732B2

(12) United States Patent
Furukawa et al.

(10) Patent No.: US 11,763,732 B2
(45) Date of Patent: Sep. 19, 2023

(54) DISPLAY DEVICE AND IMAGE PROCESSING METHOD

(71) Applicant: SHARP KABUSHIKI KAISHA, Sakai (JP)

(72) Inventors: Hiroyuki Furukawa, Sakai (JP); Masafumi Ueno, Sakai (JP); Naoto Inoue, Sakai (JP); Chie Toridono, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 34 days.

(21) Appl. No.: 17/616,076

(22) PCT Filed: Jun. 25, 2019

(86) PCT No.: PCT/JP2019/025239

§ 371 (c)(1),
(2) Date: Dec. 2, 2021

(87) PCT Pub. No.: WO2020/261398

PCT Pub. Date: Dec. 30, 2020

(65) Prior Publication Data

US 2022/0319402 A1 Oct. 6, 2022

(51) Int. Cl.
*G09G 3/32* (2016.01)

(52) U.S. Cl.
CPC ..... *G09G 3/32* (2013.01); *G09G 2320/0209* (2013.01); *G09G 2360/144* (2013.01)

(58) Field of Classification Search
CPC ..... G09G 2320/0209; G09G 2360/144; G09G 3/32; G09G 2320/0276; G09G 2320/0242; G09G 3/3413; G09G 2360/145
See application file for complete search history.

(56) References Cited

U.S. PATENT DOCUMENTS

2008/0224966 A1* 9/2008 Cok ..... G09G 3/32 345/82
2016/0217723 A1* 7/2016 Kim ..... G09G 3/2003
2016/0267834 A1* 9/2016 Zheng ..... G09G 3/32
2019/0206315 A1* 7/2019 Park ..... G09G 3/3233

FOREIGN PATENT DOCUMENTS

JP 2000-321559 A 11/2000

* cited by examiner

*Primary Examiner* — Muhammad N Edun
(74) *Attorney, Agent, or Firm* — ScienBiziP, P.C.

(57) ABSTRACT

A display device includes: a light-emitting profile creation circuit creating a first light-emitting profile from a first image signal; and an image signal adjustment circuit adjusting a second image signal in accordance with the first light-emitting profile.

14 Claims, 6 Drawing Sheets

(a)

TWO-DIMENSIONAL GAUSSIAN DISTRIBUTION (b)

| | | | | | | |
|---|---|---|---|---|---|---|
| 0 | 0 | 0 | 0 | 119 | 220 | 0 |
| 1 | 133 | 0 | 128 | 49 | 77 | 4 |
| 0 | 0 | 15 | 0 | 0 | 0 | 0 |
| 0 | 255 | 14 | 255 | 68 | 13 | 0 |
| 0 | 0 | 0 | 128 | 25 | 0 | 0 |
| 3 | 91 | 128 | 120 | 0 | 0 | 0 |
| 0 | 0 | 192 | 50 | 0 | 0 | 0 |

INPUT IMAGE:f (c)

| | | | | | | |
|---|---|---|---|---|---|---|
| 1 | 1 | 2 | 2 | 2 | 1 | 1 |
| 1 | 2 | 2 | 4 | 2 | 2 | 1 |
| 2 | 2 | 4 | 8 | 4 | 2 | 2 |
| 2 | 4 | 8 | 16 | 8 | 4 | 2 |
| 2 | 2 | 4 | 8 | 4 | 2 | 2 |
| 1 | 2 | 2 | 4 | 2 | 2 | 1 |
| 1 | 1 | 2 | 2 | 2 | 1 | 1 |

POINT SPREAD FUNCTION (TWO-DIMENSIONAL GAUSSIAN DISTRIBUTION):g

DISPLAY DEVICE AND IMAGE PROCESSING METHOD

TECHNICAL FIELD

The disclosure relates to a display device and an image processing method.

BACKGROUND ART

Various kinds of display devices are being developed in recent years. In particular, display devices including quantum-dot light-emitting diodes (QLEDs) are attracting significant attention because they can present images with high quality while provided in a thin profile and operating on low power. In order to present images with higher quality, these display devices commonly perform image processing such as correction of image signals.

Patent Document 1, for example, discloses a technique as to processing for correction of an image signal in a flat-panel display. When crosstalk is created in a liquid crystal display device in accordance with a relationship between a thickness of an insulating layer and a size of a pixel, the technique calculates the amount of the crosstalk from a signal to be applied to a neighboring pixel and corrects the image signal.

CITATION LIST

Patent Literature

[Patent Document 1] Japanese Unexamined Patent Application Publication No. 2000-321559 (published on Nov. 24, 2000)

SUMMARY

Technical Problem

In the case of the technique disclosed in Patent Document 1, the correction of the image signal is performed only for a common source wire and neighboring pixels connected to, or electrically coupled to, the common gate wire. Hence, a problem of the technique is that the correction of the image signal cannot be performed as a countermeasure against the effect of stray light from an electrically unrelated pixel.

FIG. 7 is a diagram illustrating a schematic configuration of a display device 100, an example of a display device including QLEDs.

The display device 100 includes: a quantum-dot light-emitting diode 105R including a light-emitting layer in red R; a quantum-dot light-emitting diode 105G including a light-emitting layer in green G; and a quantum-dot light-emitting diode 105B including a light-emitting layer in blue B. Each of the quantum-dot light-emitting diodes 105R, 105G, and 105B is an individual sub-pixel in the display device 100. These quantum-dot light-emitting diodes 105R, 105G, and 105B are formed on a not-shown substrate. The quantum-dot light-emitting diodes 105R, 105G, and 105B have light-emitting faces provided with a sealing layer 106.

The quantum-dot light-emitting diodes 105R, 105G, and 105B have two light-emitting modes. One of the modes is an electroluminescence (EL) mode that involves exciting quantum dots by electric energy to emit light, and the other mode is a photoluminescence (PL) mode that involves exciting quantum dots by light to emit light. The display device 100 operates in the EL mode and uses, as the light-emitting layers, quantum-dot materials corresponding the wavelengths of RGB. Thus, the display device 100 emits: a red light R(EL) in the EL mode from the quantum-dot light-emitting diode 105R; a green light G(EL) in the EL mode from the quantum-dot light-emitting diode 105G; and a blue light B(EL) in the EL mode from the quantum-dot light-emitting diode 105B, each light being controlled at a predetermined electric energy level. This is how the display device 100 works as a light-emitting display device.

However, the colored lights in the EL mode from the quantum-dot light-emitting diodes 105R, 105G, and 105B include stray light. FIG. 7 shows only a stray light B(M) included in the blue light B(EL) in the EL mode from the quantum-dot light-emitting diode 105B. The stray light is also included in the red light R(EL) in the EL mode from the quantum-dot light-emitting diode 105R and in the green light G(EL) in the EL mode from the quantum-dot light-emitting diode 105G.

As illustrated in FIG. 7, the stray light B(M), which is included in the blue light B(EL) in the EL mode from the quantum-dot light-emission diode 105B, affects the quantum-dot light-emission diodes 105R and 105G. Other than the light to be originally emitted in the EL mode, the quantum-dot light-emission diodes 105R and 105G inevitably create unnecessary excitation lights R(PL) and G(PL) by the stray light B(M) in the PL mode. The problem is that, because of the light emitted from the quantum-dot light-emission diode 105B nearby, intensity of the lights emitted from the quantum-dot light-emission diodes 105R and 105G is inevitably different from what it is originally intended to be.

Moreover, the unnecessary excitation light R(PL) in the PL mode from the quantum-dot light-emission diode 105R also includes an effect of not-shown stray light included in the green light G(EL) in the EL mode from the quantum-dot light-emission diode 105G.

In view of the above problems, an aspect of the disclosure is intended to provide a display device and an image processing method capable of correcting an image signal as a countermeasure against an effect of stray light.

Solution to Problems

In order to solve the above problems, a display device according to the disclosure includes:

a first sub-pixel and a second sub-pixel, the first sub-pixel including a first light-emitting layer emitting light in a first color, the second sub-pixel including a second light-emitting layer emitting light in a second color having a wavelength longer than a wavelength of the first color, and the second light-emitting layer containing quantum dots;

a light-emitting profile creation circuit creating a first light-emitting profile of the first sub-pixel, the first light-emitting profile being created from a first image signal corresponding to the first sub-pixel; and an image signal adjustment circuit adjusting a second image signal corresponding to the second sub-pixel, the second image signal being adjusted in accordance with the first light-emitting profile.

In order to solve the above problems, an image processing method is used for a display device including:

a first sub-pixel and a second sub-pixel, the first sub-pixel including a first light-emitting layer emitting light in a first color, the second sub-pixel including a second light-emitting layer emitting light in a second color having a wavelength longer than a wavelength of the first color, and the second light-emitting layer containing quantum dots. The image processing method includes:

creating a first light-emitting profile, of the first sub-pixel, from a first image signal corresponding to the first sub-pixel; and adjusting a second image signal, corresponding to the second sub-pixel, in accordance with the first light-emitting profile.

Advantageous Effects of Disclosure

An aspect of the disclosure can provide a display device and an image processing method capable of correcting an image signal as a countermeasure against an effect of stray light.

BRIEF DESCRIPTION OF DRAWINGS

FIG. 1(*b*) is a cross-sectional view of a configuration of the display panel included in the display device according to the first embodiment.

FIG. 3(*b*) is a graph illustrating an example of a point spread function (psf) to be used in the light-emitting profile creation circuit. FIG. 3(*c*) is a graph illustrating an example of PL light correction to be performed by the image signal adjustment circuit.

FIG. 4(*b*) is a diagram showing exemplary data values of a first image signal subjected to γ correction, the first image signal being used for convulsion to be performed by the light-emitting profile creation circuit. FIG. 4(*c*) is a diagram showing data values of the point spread function (psf) illustrated in FIG. 4(*a*), the point spread function (psf) being used for the convulsion to be performed by the light-emitting profile creation circuit.

DESCRIPTION OF EMBODIMENTS

Described below are embodiments of the disclosure, with reference to FIGS. 1 to 6. For the sake of description, identical reference signs are used to denote identical or substantially identical features throughout the embodiments. Such features would not be repeatedly elaborated upon.

First Embodiment

Figure 1:
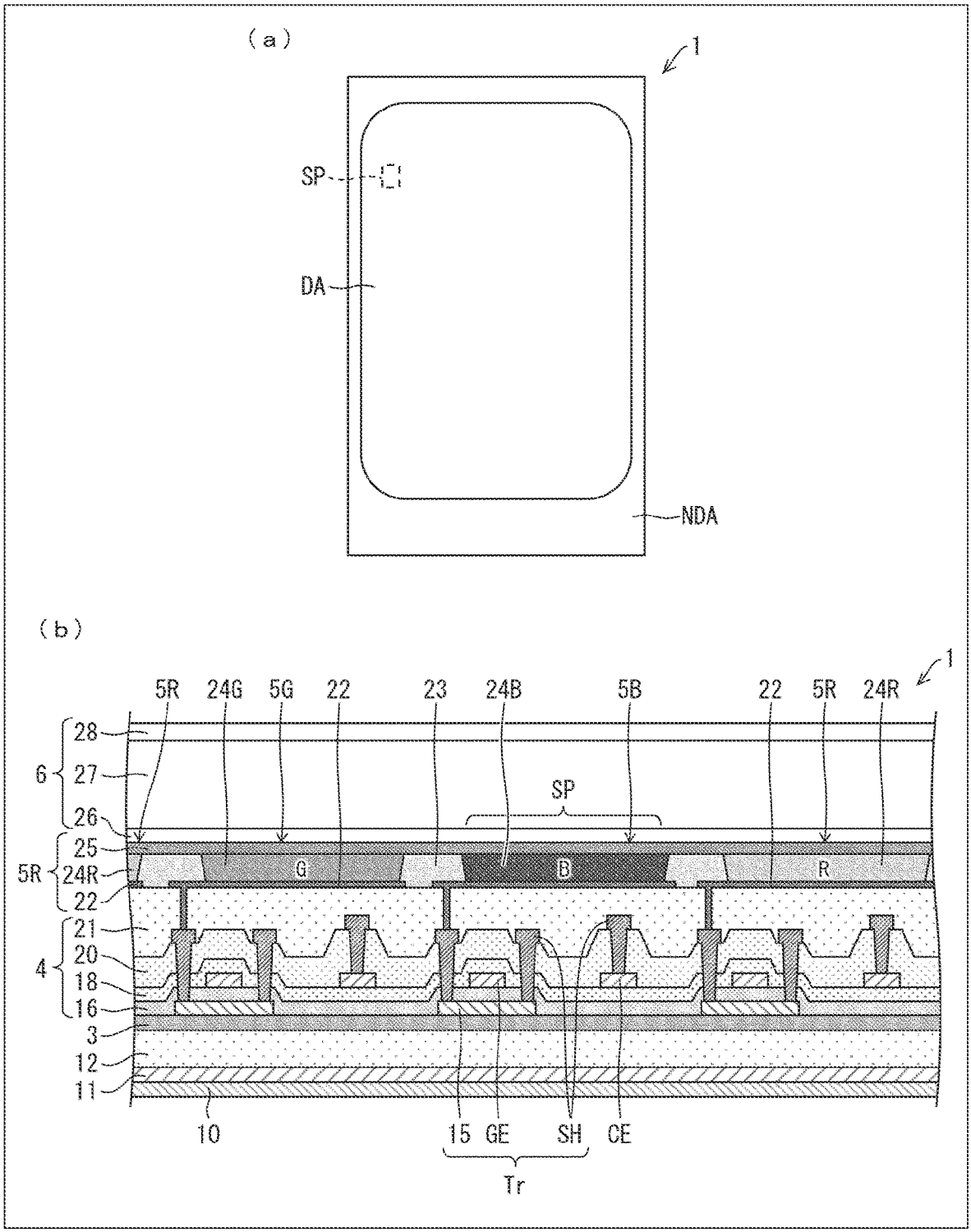
FIG. 1(*a*) is a schematic plan view of a configuration of a display panel included in a display device according to a first embodiment.

FIG. 1(*a*) is a schematic plan view of a configuration of a display panel 1 included in a display device 30 according to a first embodiment. FIG. 1(*b*) is a cross-sectional view of a configuration of the display panel 1 included in the display device 30 according to the first embodiment.

As illustrated in FIG. 1(*a*), the display panel 1 includes: a display region DA; and a frame region NDA surrounding the display region DA. The display region DA includes a plurality of sub-pixels SP.

As illustrated in FIG. 1(*b*), the display region DA of the display panel 1 includes: an adhesive layer 11; a resin layer 12; a barrier layer 3; a thin-film transistor layer (a TFT layer) 4; light-emitting elements 5R, 5G, and 5B; and a sealing layer 6, all of which are provided on a base substrate 10 in the stated order.

As an example, the base substrate 10 is made of, but not limited to, polyethylene terephthalate (PET).

As an example, the adhesive layer 11 is made of, but not limited to, optical clear adhesive (OCA) or optical clear resin (OCR).

As an example, the resin layer 12 is made of, but not limited to, such resins as polyimide resin, epoxy resin, and polyamide resin.

The barrier layer 3 prevents water and impurities from reaching a transistor Tr and the light-emitting elements 5R, 5G, and 5B. The barrier layer 3 can be made of a silicon oxide film, a silicon nitride film, or a silicon oxide nitride film formed by, for example, CVD. Alternatively, the barrier layer can be made of a multilayer film including these films.

The transistor Tr and a capacitance element are provided above the resin layer 12 and the barrier layer 3. The thin-film transistor layer 4, including the transistor Tr and the capacitance element, includes: a semiconductor film 15; an inorganic insulating film (a gate insulating film) 16 above the semiconductor film 15; a gate electrode GE above the inorganic insulating film 16; an inorganic insulating film (a first insulating film) 18 above the gate electrode GE; a counter electrode CE, of the capacitance element, above the inorganic insulating film 18; an inorganic insulating film (a second insulating film) 20 above the counter electrode CE of the capacitance element; a layer SH provided above the inorganic insulating film 20, and forming a source electrode, a drain electrode, and wires of the source electrode and the drain electrode; and an interlayer insulating film 21 above the layer SH forming the source electrode, the drain electrode, and the wires of the source electrode and the drain electrode.

Note that the capacitance element includes: the counter electrode CE, of the capacitance element, formed directly above the inorganic insulating film 18; the inorganic insulating film 18; and a capacitance electrode formed directly below the inorganic insulating film 18 to overlap, in the same layer as the gate electrode GE is formed, the counter electrode CE of the capacitance element.

The transistor (the thin-film transistor, or the TFT) Tr includes: the semiconductor film 15; the inorganic insulating film 16; the gate electrode GE; the inorganic insulating film 18; the inorganic insulating film 20; the source electrode; and the drain electrode.

The semiconductor film 15 is made of, for example, low-temperature polysilicon (LTPS), or an oxide semiconductor.

The gate electrode GE, the counter electrode CE of the capacitance element, and the layer SH forming the source electrode, the drain electrode, and the wires of the source electrode and the drain electrode are made of a monolayer metal film formed of at least one of such metals as aluminum (Al), tungsten (W), molybdenum (Mo), tantalum (Ta), chromium (Cr), titanium (Ti), copper (Cu), and silver (Ag).

Alternatively, the gate electrode GE, the counter electrode CE, and the layer SH are made of a multilayer metal film including these metals.

Each of the inorganic insulating films 16, 18, and 20 can be made of a silicon oxide ($SiO_x$) film, a silicon nitride ($SiN_x$) film, or a silicon oxide nitride film formed by, for example, CVD. Alternatively, the inorganic insulating films 16, 18, and 20 can be made of a multilayer film including these films.

The planarization film 21 can be made of, for example, an applicable photosensitive organic material such as polyimide resin and acrylic resin.

The light-emitting elements 5R, 5G, and 5B include: a first electrode 22 provided above the interlayer insulating film 21; functional layers 24R, 24G, and 24B provided above the first electrode 22, and including light-emitting layers of respective colors; and a second electrode 25 provided above the functional layers 24R, 24G, and 24B. Formed on the interlayer insulating film 21 is an edge cover (a bank) 23 covering an edge of the first electrode 22.

A sub-pixel SP, including the light-emitting element 5R to glow red (a third color), includes the functional layer 24R containing the light-emitting layer of red (the third color). A sub-pixel SP, including the light-emitting element 5G to glow green (a second color), includes the functional layer 24G containing the light-emitting layer of green (the second color). A sub-pixel SP, including the light-emitting element 5B to glow blue (a first color), includes the functional layer 24B containing the light-emitting layer of blue (the first color).

Note that, in this embodiment, as an example, the first color is blue, the second color is green, and the third color is red. However, the colors shall not be limited to this example. The second color may be of light in a visible light range whose wavelength is longer than a wavelength of the first color. The third color may be of light in a visible light region whose wavelength is longer than the wavelength of the second color.

Moreover, in this embodiment, as an example, one pixel includes, but not limited to, three sub-pixels SP; that is, the sub-pixel SP glowing red, the sub-pixel SP glowing green, and the sub-pixel glowing blue. However, the pixel shall not be limited to the example. Alternatively, one pixel may include four or more sub-pixels. In such a case, the sub-pixels may include another sub-pixel glowing with another color than red, green, and blue.

The display panel 1 includes: the first electrode 22 for each sub-pixel SP; the functional layers 24R, 24G, and 24B provided for the respective sub-pixels SP and including the light-emitting layers of respective colors; and the second electrode 25. The edge cover 23 can be made of, for example, an applicable photosensitive organic material such as polyimide resin and acrylic resin.

Each of the functional layers 24R, 24G, and 24B includes a hole-injection layer, a hole-transport layer, a light-emitting layer, an electron-transport layer, and an electron-injection layer stacked on top of another in the stated order from below. The light-emitting layer is formed by vapor deposition or ink-jet printing, and shaped into an island for each sub-pixel SP. The other layers can be each formed as a common layer shaped into a monolithic form. Each of the functional layers 24R, 24G, and 24B may omit one or more of the hole-injection layer, the hole-transport layer, the electron-transport layer, and the electron-injection layer.

In this embodiment, as an example, the light-emitting layer included in each of the functional layers 24R, 24G, and 24B contains, but not limited to, a phosphor of quantum dots (nano particles). Alternatively, only the light-emitting layer included in at least one of the functional layers 24R and 24G may contain the phosphor of the quantum dots (nano particles). Examples of a specific material of the light-emitting layer containing the phosphor of quantum dots (nano particles) include any of CdSe/CdS, CdSe/ZnS, InP/ZnS, and CIGS/ZnS. The phosphor of quantum dots (nano particles) has a particle size approximately ranging from 3 to 10 nm. Note that the light-emitting layer included in the functional layer 24R and containing the phosphor of quantum dots (nano particles), the light-emitting layer included in the functional layer 24G and containing the phosphor of quantum dots (nano particles), and the light-emitting layer included in the functional layer 24B and containing the phosphor of quantum dots (nano particles) are formed so that light rays emitted from the light-emitting layers have different central wavelengths. To obtain different central wavelengths, the phosphors may be different in particle size and kind of quantum dots (nano particles).

The first electrode 22 can be made of a multilayer including, for example, indium tin oxide (ITO) and an alloy containing Ag. Alternatively, the first electrode 22 may be made of any given material as long as the first electrode 22 can conduct electricity and reflect light. The second electrode 25 can be made of a material electrically conductive and transparent to light such as indium tin oxide (ITO) and indium zinc oxide (IZO). Alternatively, the second electrode 25 may be made of any given material as long as the second electrode 25 can be electrically conductive and transparent to light.

The first electrode 22 is provided for each of the sub-pixels SP, and electrically connected to a drain electrode of the transistor Tr. The second electrode 25 is provided in common among all the sub-pixels SP. The transistor Tr is driven for each of the sub-pixels SP.

The sealing layer 6 is light-transparent, and includes: a first inorganic sealing film 26 covering the second electrode 25; an organic sealing film 27 formed above the first inorganic sealing film 26; and a second inorganic sealing film 28 covering the organic sealing film 27. The sealing layer 6 covering the light-emitting elements 5R, 5G, and 5B prevents such foreign objects as water and oxygen from penetrating into the light-emitting elements 5R, 5G, and 5B.

Each of the first inorganic sealing film 26 and the second inorganic sealing film 28 can be made of a silicon oxide film, a silicon nitride film, or a silicon oxide nitride film formed by, for example, CVD. Alternatively, each of the first inorganic sealing film 26 and the second inorganic sealing film 28 can be made of a multilayer film including these films. The organic sealing film 27 is a light-transparent organic film thicker than the first inorganic sealing film 26 and the second sealing film 28. The organic sealing film 27 can be made of an applicable photosensitive organic material such as polyimide resin and acrylic resin.

In this embodiment, for example, the sealing layer 6 includes one organic film and two inorganic films; that is, the first and second inorganic sealing film 26 and 28 and the organic sealing film 27 provided therebetween. However, the sealing layer 6 may include any given film. Alternatively, the sealing layer 6 may include one or more inorganic films alone, or one or more organic films alone. The sealing layer 6 may also include two or more inorganic films and two or more organic films.

In this embodiment, for example, the display panel 1 is a flexible display panel, and the base substrate 10, namely a flexible substrate, is attached to the resin layer 12 through the adhesive layer 11. However, the display pane 1 may be produced in any given structure. For example, omitted may be the step of attaching the base substrate 10, namely a flexible substrate, through the adhesive layer 11. The resin layer 12 may be used as it is as the flexible substrate. The display panel 1 may also be a non-flexible display panel. In such a case, for example, the base substrate 10, the adhesive layer 11, and the resin layer 12 may be omitted, and the barrier layer 3 may be directly formed on a glass substrate, namely a non-flexible substrate.

Figure 2:
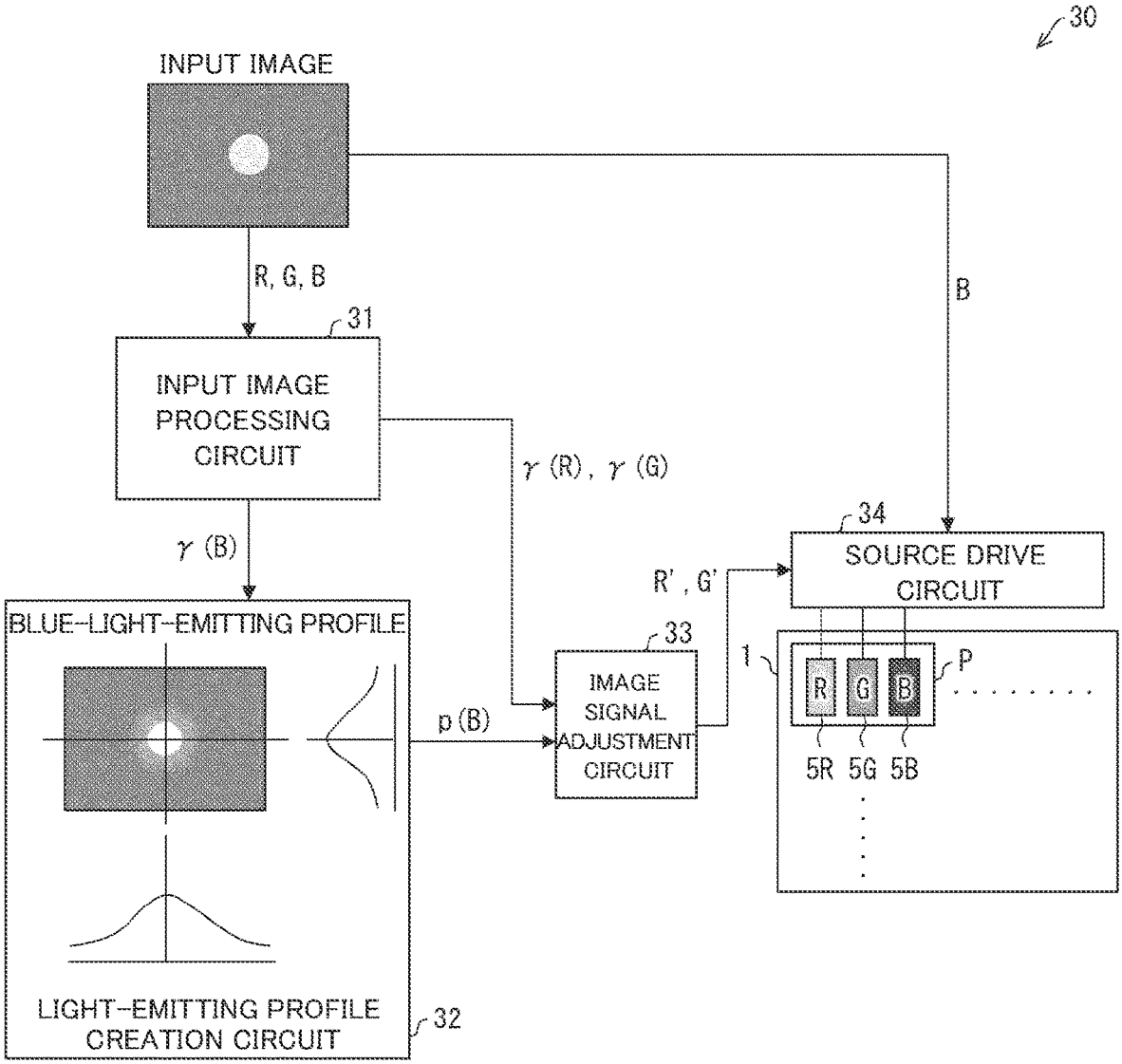
FIG. 2 is a diagram illustrating an exemplary configuration of a circuit of the display device according to the first embodiment.

FIG. 2 is a diagram illustrating an exemplary configuration of a circuit of the display device 30 according to the first embodiment.

Figure 3:
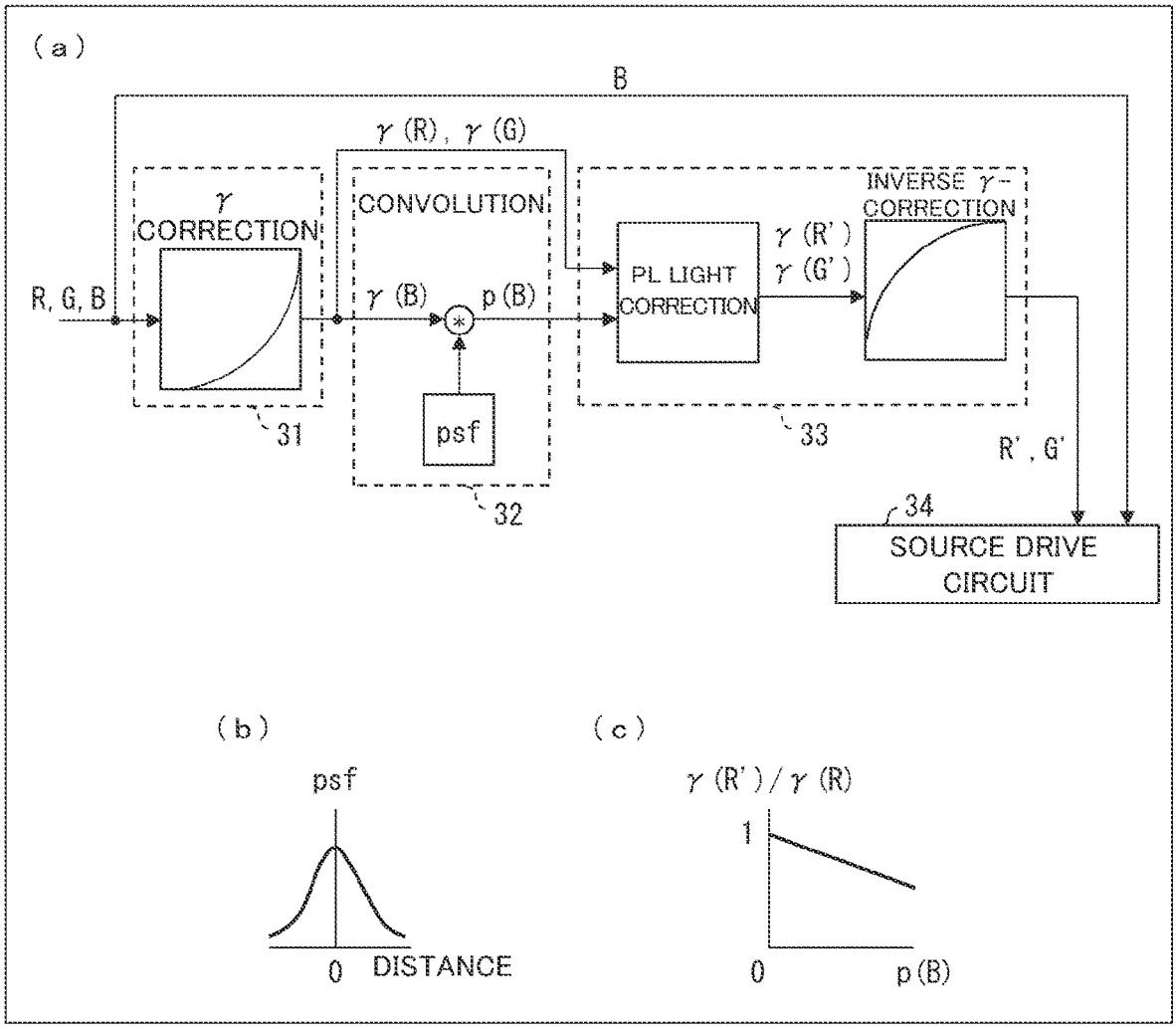
FIG. 3(*a*) is a diagram illustrating image processing performed by a light-emitting profile creation circuit and an image signal adjustment circuit included in the display device according to the first embodiment.

FIG. 3(*a*) is a diagram illustrating image processing performed by a light-emitting profile creation circuit 32 and an image signal adjustment circuit 33 included in the display device 30. FIG. 3(*b*) is a graph illustrating an example of a point spread function (psf), for blue, to be used in the light-emitting profile creation circuit 32. FIG. 3(*c*) is a graph illustrating an example of PL light correction to be performed by the image signal adjustment circuit 33.

Figure 4:
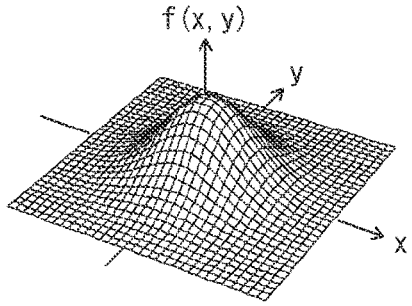
FIG. 4(*a*) is an illustration of a two-dimensional Gaussian distribution, an example of the point spread function (psf).

FIG. 4(*a*) is an illustration of a two-dimensional Gaussian distribution, an example of the point spread function (psf) for blue. FIG. 4(*b*) is a diagram showing exemplary data values of a first image signal γ(B) subjected to γ correction. The first image signal γ(B) is used for convulsion to be performed by the light-emitting profile creation circuit 32. FIG. 4(*c*) is a diagram showing data values of the point spread function (psf) for blue illustrated in FIG. 4(*a*). The point spread function (psf) is used for the convulsion to be performed by the light-emitting profile creation circuit 32.

As illustrated in FIG. 2, the display device 30 includes: the display panel 1 described above; an input image processing circuit 31; the light-emitting profile creation circuit 32; the image signal adjustment circuit 33; a source drive circuit 34; and a gate drive circuit (not shown).

The display panel 1 includes a plurality of pixels P. Each of the pixels P includes: a sub-pixel SP glowing red; a sub-pixel SP glowing green; and a sub-pixel SP growing blue. The sub-pixel SP glowing red includes the light-emitting element 5R. The sub-pixel SP glowing green includes the light-emitting element 5G. The sub-pixel SP glowing blue includes light-emitting element 5B.

As illustrated in FIG. 2 and FIG. 3(*a*), input into the input image processing circuit 31 are a first image signal B, a second image signal G, and a third image signal R in accordance with an input image. The first image signal B is luminance data of the sub-pixel SP glowing blue. The second image signal G is luminance data of the sub-pixel SP glowing green. The third image signal R is luminance data of the sub-pixel SP glowing red. The input image processing circuit 31 performs γ correction onto each of the input signals; that is, the first image signal B, the second image signal G, and the third image signal R. After that, the input image processing signal circuit 31 outputs to the light-emitting profile creation circuit 32 the first image signal γ(B) subjected to the γ correction, and to the image signal adjustment circuit 33 a second image signal γ(G) and a third image signal γ(R) subjected to the γ correction. This embodiment shows an example in which the input image processing circuit 31, performing the γ correction onto an input image signal, is provided separately from the light-emitting profile creation circuit 32 and the image signal adjustment circuit 33. However, this embodiment shall not be limited to such a configuration. For example, each of the light-emitting profile creation circuit 32 and the image signal adjustment circuit 33 may include the input image processing circuit 31 performing the γ correction onto an input image signal.

As illustrated in FIG. 2 and FIG. 3(*a*), the light-emitting profile creation circuit 32 performs convolution on: the first image signal γ(B) subjected to the γ correction; and the point spread function (psf) for blue illustrated in FIG. 3(*b*). The resulting value of the convolution, a first light-emitting profile p(B), is output to the image signal adjustment circuit 33. Note that the first light-emitting profile p(B) indicates a two-dimensional distribution of blue stray light.

In this embodiment, the light-emitting profile creation circuit 32 creates the first light-emitting profile p(B) indicating the two-dimensional distribution of the blue stray light, using a point spread function (psf), for blue, indicating a two-dimensional Gaussian distribution illustrated, for example, in FIG. 4(*a*). The point spread function (psf) for blue indicates how luminance of a blue point light source spreads two-dimensionally. To put it most simply, the function is a two-dimensional Gaussian distribution vertically and horizontally symmetrical, indicating a curve exponentially decaying with the square of a distance from the point light source.

This embodiment shows, as an example, a case of a point spread function (psf), for blue, indicating the two-dimensional Gaussian distribution illustrated in FIG. 4(*a*). However, the point spread function (psf) can be obtained by any given technique. In fact, a value of the point spread function (psf) for blue is determined preferably by actual measurement because the decay rate and the distribution vary depending on, for example, an electrode structure, a shape, and a material of the display panel 1. For example, the value of the point spread function (psf) for blue may be determined, using a pixel designing parameter (to be determined by a distance to a reflective layer and properties of, for example, materials) to carry out a simulation to track the light ray. Moreover, data of the point spread function (psf) for blue may be obtained, for example, as follows: Only the sub-pixel SP for blue may be rendered to glow, and the glow may be measured with a two-dimensional luminance meter. The obtained data may be shaped (for example, smoothed to remove noise) to represent the data of the point spread function (psf) for blue.

Furthermore, the point spread function (psf) for blue is defined by an optically linear region. Hence, in order to obtain the first image signal γ(B), subjected to the γ correction, on which convulsion is performed together with the point spread function (psf) for blue, the first image signal B is preferably γ-corrected to form an optical linear region.

FIG. 4(*b*) is a diagram showing exemplary data values of the first image signal γ(B) subjected to the γ correction. The first image signal γ(B) is used for convulsion to be performed by the light-emitting profile creation circuit 32. FIG. 4(*c*) is a diagram showing data values of the point spread function (psf), for blue, illustrated in FIG. 4(*a*). The point spread function (psf) is used for the convulsion to be performed by the light-emitting profile creation circuit 32.

FIG. 4(*b*) shows data values of the first image signal γ(B) subjected to the γ correction. The data values have grayscale values ranging from 0 to 255, and indicate a luminance distribution of blue light in a portion (a 7×7 pixel region) of the display region DA in the display panel 1.

FIG. 4(*c*) shows data values of the point spread function (psf) for blue. The data values are those of the point spread function (psf), for blue, indicating the two-dimensional Gaussian distribution illustrated in FIG. 4(*a*). The data values in FIG. 4(*c*) correspond to the portion (the 7×7 pixel region) of the display region DA in the display panel 1. In FIG. 4(*c*), a pixel whose luminance level is "16" glows with a luminance level of "16". The point spread function (psf)

for blue in FIG. 4(*c*) shows how the luminance distributes around the pixel. Note that the values of the point spread function (psf) for blue can be normalized as necessary.

Note that this embodiment shows an example in which the data values of the first image signal γ(B) subjected to the γ correction have the grayscale values ranging from 0 to 255. However, the data values of the first image signal γ(B) subjected to the γ correction shall not be limited to the grayscale values in this range. The amount of the data may be either larger or smaller than that in this embodiment. Furthermore, in this embodiment, the data values of the point spread function (psf) for blue are those when a center pixel glows with a luminance level of "16". However, the luminance level of the center pixel shall not be limited to "16". The luminance level of the center pixel may be determined as appropriate.

In FIG. 4(*b*), a pixel in the center of the region outlined in bold black lines (the 7×7 pixel region) is designated as a target pixel. Using the data values of the point spread function (psf) for blue shown in FIG. 4(*c*), a convulsion can be performed on a region including three pixels each to the top, bottom, right, and left of the target pixel.

The convulsion can be performed, using an expression below. That is, the convulsion can be performed by a multiply-accumulate operation of corresponding coordinate sets of data values of the first image signal γ(B) subjected to the γ correction shown in FIG. 4(*b*) and the data values of the point spread function (psf) for blue shown in FIG. 4(*c*).

$$1/140\Sigma_{i=0}^{6}\Sigma_{j=0}^{6}[f(i,j)\times g(i,j)] \quad \text{[Math. 1]}$$

The value obtained using the above expression is [(0×1+0×1+0×2+0×2+119×2+220×1+0×1)+(1×1+133×2+0×2+128×4+49×2+77×2+4×1)+ . . . +(0×1+0×1+×192×2+50×2+0×2+0×1+0×1)]÷140=70.6. This value is the first light-emitting profile p(B) corresponding to coordinates of the target pixel and created by the glows of blue in the 7×7 pixel region; that is, the region including three pixels each to the top, bottom, right, and left of the target pixel.

Moreover, the value 140 in the above expression is the total sum of the data values of the point spread function (psf) for blue shown in FIG. 4(*c*).

Note that this embodiment shows an example in which the convulsion is performed on, but not limited to, the 7×7 pixel region as a single block. Alternatively, the area of the pixel region as a single block may be determined as appropriate.

Likewise, the convulsion is performed on each of the coordinate sets of all the pixels (for each of the pixels) of the display region DA in the display panel 1, that is, the convulsion is performed for a different target pixel. Such a feature makes it possible to create the first light-emitting profile p(B) for all the pixels of the display region DA in the display panel 1.

As illustrated in FIG. 2 and FIG. 3(*a*), the image signal adjustment circuit 33 performs photoluminescence (PL) light correction onto the second image signal γ(G) and the third image signal γ(R) subjected to the γ correction, in accordance with the first light-emitting profile p(B). Hence, the image signal adjustment circuit 33 can obtain a second image signal γ(G') and a third image signal γ(R') subjected to the PL light correction. The second image signal γ(G') and the third image signal γ(R') subjected to the PL light correction are inverse-γ-corrected to be brought back to the original data regions, and are output to the source drive circuit 34 as a second image signal G' and a second image signal R' subjected to adjustment. Moreover, input into the source drive circuit 34 is a first image signal B in the same digital data region as that of the first image signal B to be input into the input image processing circuit 31 and representing the luminance data of the sub-pixel SP glowing blue.

As described above, the first light-emitting profile p(B) indicates the two-dimensional distribution of the blue stray light. Hence, performing the PL light correction onto the second image signal γ(G) and the third image signal γ(R) subjected to the γ correction specifically means performing correction to reduce light to cancel photoexcitation by the blue stray light (subtraction processing).

As illustrated in FIG. 3(*c*), γ(R')/γ(R) is closer to 1 as the value of the first profile p(B) is smaller. That is, the amount of the PL light correction decreases with decreasing blue stray light. Hence, the values of γ(R') and γ(R) are close to each other. Meanwhile, the amount of PL light correction increases as the value of the first light-emitting profile p(B) is larger, and the PL light correction reduces light to cancel photoexcitation caused by the blue stray light. Hence, the value of γ(R') is smaller than the value of γ(R), depending on the amount of the PL light correction. Although not shown, the relationship between the first light-emitting profile p(B) and the γ(G')/γ(G) is also the same as the relationship illustrated in FIG. 3(*c*).

Note that because the photoluminescence (PL) light emission is caused by the blue stray light, the first light-emitting profile p(B), which is obtained by the light-emitting profile creation circuit 32, and γ(Gp(B)), which is the amount of PL light emission due to an effect of the blue stray light in a sub-pixel SP glowing green, satisfy a relationship of γ(Gp(B))=α×p(B) (where α is a coefficient indicating a blue light excitation characteristic of the sub-pixel SP glowing green). That is, γ(Gp(B)), which is the amount of the PL light-emission due to the effect of the blue stray light in the sub-pixel SP glowing green, is proportional to the first light-emitting profile p(B). The second image signal γ(G') subjected to the PL light correction can be obtained, using Equation A below.

$$\gamma(G')=\gamma(G)-\gamma(Gp(B))=\gamma(G)-\alpha\times p(B) \quad \text{(Equation A)}$$

Likewise, the first light-emitting profile p(B), which is obtained by the light-emitting profile creation circuit 32, and γ(Rp(B)), which is the amount of PL light emission due to an effect of blue stray light in a sub-pixel SP glowing red, satisfy a relationship of γ(Rp(B))=β×p(B) (where β is a coefficient indicating a blue light excitation characteristic of the sub-pixel SP glowing red). That is, γ(Rp(B)), which is the amount of the PL light-emission due to the effect of the blue stray light in the sub-pixel SP glowing red, is proportional to the first light-emitting profile p(B). The third image signal γ(R') subjected to the PL light correction can be obtained, using Equation B below.

$$\gamma(R')=\gamma(R)-\gamma(Rp(B))=\gamma(R)-\beta\times p(B) \quad \text{(Equation B)}$$

As can be seen, the display device 30 can correct an image signal as a countermeasure against an effect of stray light.

Note that, in the display device 30, the light-emitting layer, included in the light-emitting element 5B and emitting blue light, emits light by electroluminescence based on the first image signal B. The light-emitting layer, included in the light-emitting element 5G and emitting green light, emits light by: electroluminescence based on the second image signal G' subjected to adjustment; and photoluminescence with light from the light-emitting layer included in the light-emitting element 5B and emitting blue light. The light-emitting layer, included in the light-emitting element 5R and emitting red light, emits light by: electroluminescence based on the third image signal R' subjected to adjustment; photoluminescence with light from the light-emitting layer included in the light-emitting element 5B and emitting blue light; and photoluminescence with light from the light-emitting layer included in the light-emitting element 5G and emitting green light.

Second Embodiment

Described below is a second embodiment according to the disclosure, with reference to FIG. 5. An image signal adjustment circuit 33' included in a display device 40 according to this embodiment is different from the image signal adjustment circuit 33 included in the display device 30 according to the first embodiment in that the former obtains the third image signal γ(R') subjected to the PL light correction in accordance with the first light-emitting profile p(B) and a second light-emitting profile p(G). Other than that, the features of the second embodiment are the same as those of the first embodiment. As a matter of convenience, identical reference signs are used to denote functionally identical components in the drawings between this embodiment and the first embodiment. Such components will not be repeatedly elaborated upon.

Figure 5:
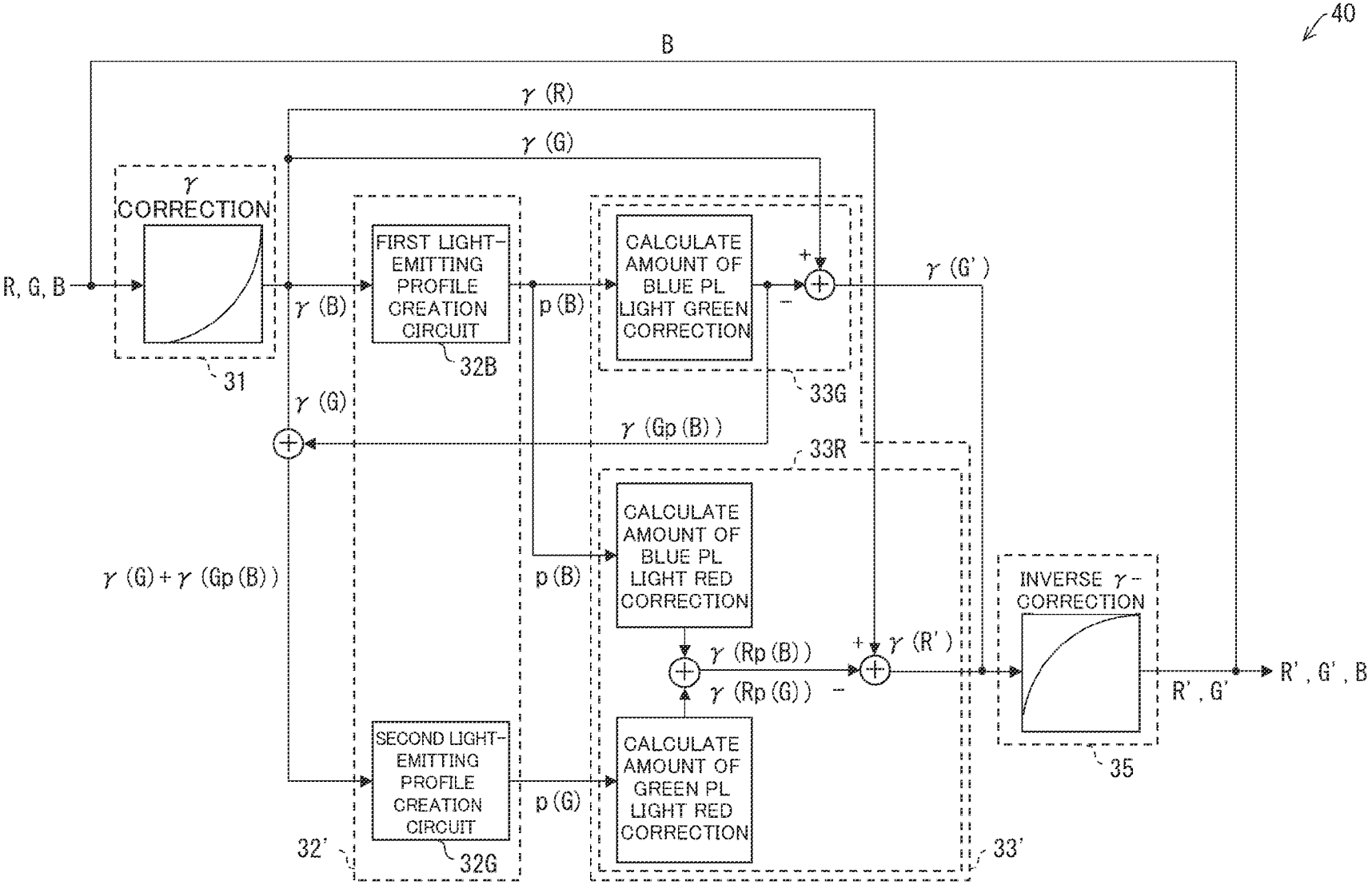
FIG. 5 is a diagram illustrating an exemplary configuration of a circuit of a display device according to a second embodiment.

FIG. 5 is a diagram illustrating an exemplary configuration of a circuit of the display device 40 according to the second embodiment.

As illustrated in FIG. 5, the display device 40 includes: the display panel (not-shown) described in the first embodiment; the input image processing circuit 31; a light-emitting profile creation circuit 32'; the image signal adjustment circuit 33'; an output image processing circuit 35; the source drive circuit (not shown) described in the first embodiment; and a gate drive circuit (not shown).

The light-emitting profile creation circuit 32' includes a first light-emitting profile creation circuit 32B performing convolution on: the first image signal γ(B) subjected to the γ correction; and the point spread function (psf) for blue illustrated in FIG. 3(*b*). The resulting value of the convolution, the first light-emitting profile p(B), is output to the image signal adjustment circuit 33'. Note that the first light-emitting profile p(B) indicates a two-dimensional distribution of blue stray light.

The image signal adjustment circuit 33' includes a generator 33G of the second image signal γ(G') subjected to the PL light correction. In accordance with the first light-emitting profile p(B) obtained by the first light-emitting profile creation circuit 32B, the generator 33G obtains γ(Gp(B)), which is the amount of the PL light emission due to an effect of blue stray light in a sub-pixel SP glowing green. Specifically, the generator 33G calculates the amount of blue PL light green correction, using Equation C below.

$$\gamma(Gp(B))=\alpha\times p(B) \quad \text{(Equation C)}$$

where α is a coefficient indicating a blue light excitation characteristic of the sub-pixel SP glowing green.

Furthermore, in accordance with the second image signal γ(G), which is subjected to the γ correction and sent from the input image processing circuit 31, and γ(Gp(B)), which is the amount of the PL light emission due to an effect of the blue stray light in the sub-pixel SP glowing green, the generator 33G can obtain the second image signal γ(G') subjected to the PL light correction, using Equation D below.

$$\gamma(G')=\gamma(G)-\gamma(Gp(B))=\gamma(G)-\alpha\times p(B) \quad \text{(Equation D)}$$

The second image signal γ(G') subjected to the PL light correction is inverse-γ-corrected by the output image processing circuit 35, and is then output to the source drive circuit (not shown) as the second image signal G' subjected to adjustment.

Moreover, the light-emitting profile creation circuit 32' includes a second light-emitting profile creation circuit 32G to be supplied with γ(G)+γ(Gp(B)); that is, a sum of the second image signal γ(G), which is subjected to the γ correction and sent from the input image processing circuit 31, and γ(Gp(B)), which is the amount of the PL light emission, from the generator 33G of the second image signal γ(G') subjected to the PL light correction, due to the effect of the blue stray light in the sub-pixel SP glowing green.

The second light-emitting profile creation circuit 32G included in the light-emitting profile creation circuit 32' performs convolution on the γ(G)+γ(Gp(B)) and the point spread function (psf) for green, as Equation E shows below. The resulting value of the convolution, the second light-emitting profile p(G), is output to the image signal adjustment circuit 33'. Note that the second light-emitting profile p(G) indicates a two-dimensional distribution of green stray light.

$$p(G)=[\gamma(G)+\gamma(Gp(B))]*G(\text{psf}) \quad \text{(Equation E)}$$

where * is an operator of the convulsion, and G(psf) is a point spread function for green. The point spread function G(psf) for green indicates how luminance of a green point light source spreads two-dimensionally. To put it most simply, the function is a two-dimensional Gaussian distribution vertically and horizontally symmetrical, indicating a curve exponentially decaying with the square of a distance from the point light source.

Note that the same function can be used as the point spread function for blue and the point spread function G(psf) for green if the sub-pixels SP glowing red, the sub-pixels SP glowing green, and the sub-pixels SP glowing blue are formed into the same shape and arranged repeatedly with regularity as seen in the display panel 1 described in the first embodiment. Hence, in this embodiment, a point spread function for blue is used as the point spread function G(psf) for green. Meanwhile, if the sub-pixels SP for the respective colors are different in area, shape, and arrangement, for example, an appropriate function has to be used accordingly.

The image signal adjustment circuit 33' includes a generator 33R of the third image signal γ(R') subjected to the PL light correction. In accordance with the first light-emitting profile p(B) obtained by the first light-emitting profile creation circuit 32B, the generator 33R obtains γ(Rp(B)), which is the amount of the PL light emission due to an effect of blue stray light in the sub-pixel SP glowing red. Specifically, the generator 33R calculates the amount of blue PL light red correction, using Equation F below.

$$\gamma(Rp(B))=\varepsilon\times p(B) \quad \text{(Equation F)}$$

where ε is a coefficient indicating a blue light excitation characteristic of the sub-pixel SP glowing red.

Moreover, in accordance with the second light-emitting profile p(G) sent from the second light-emitting profile creation circuit 32G, the generator 33R of the third image signal γ(R') subjected to the PL light correction calculates γ(Rp(G)), which is the amount of the PL light emission due to an effect of green stray light in the sub-pixel SP glowing red. Specifically, the generator 33R calculates the amount of green PL light red correction, using Equation G below.

$$\gamma(Rp(G))=\eta\times p(G) \quad \text{(Equation G)}$$

where η is a coefficient indicating a green light excitation characteristic of the sub-pixel SP glowing red.

After that, in accordance with (i) the third image signal γ(R), which is subjected to the γ correction and sent from the input image processing circuit 31, (ii) γ(Rp(B)) obtained using Equation F and representing the amount of the PL light emission due to the effect of the blue stray light in the sub-pixel SP glowing red, and (iii) γ(Rp(G)) obtained using Equation G and representing the amount of the PL light emission due to the effect of the green stray light in the sub-pixel SP glowing red, the generator 33R included in the image signal adjustment circuit 33' can obtain the third image signal γ(R') subjected to PL light correction, using Equation H.

$$\gamma(R')=\gamma(R)-[\gamma(Rp(B))+\gamma(Rp(G))] \quad \text{(Equation H)}$$

The third image signal γ(R') subjected to the PL light correction is inverse-γ-corrected by the output image processing circuit 35, and is then output to the source drive circuit (not shown) as the third image signal R' subjected to adjustment. Moreover, the source drive circuit (not shown) receives a first image signal B in the same digital data region as that of the first image signal B to be input into the input image processing circuit 31 and representing the luminance data of the sub-pixel SP glowing blue.

This embodiment shows an example in which the input image processing circuit 31, performing γ correction onto an input image signal, is provided separately from the light-emitting profile creation circuit 32' and the image signal adjustment circuit 33'. However, this embodiment shall not be limited to such a configuration. For example, each of the light-emitting profile creation circuit 32' and the image signal adjustment circuit 33' may include the input image processing circuit 31 performing γ correction onto an input image signal.

Furthermore, this embodiment shows an example in which the output image processing circuit 35, performing inverse γ-correction, is provided separately from the image signal adjustment circuit 33'. However, this embodiment shall not be limited to such a configuration. For example, the image signal adjustment circuit 33' may include the output image processing circuit 35 performing inverse γ-correction.

As described above, the first light-emitting profile p(B) indicates the two-dimensional distribution of the blue stray light. Hence, performing the PL light correction, in accordance with the first light-emitting profile p(B), onto the second image signal γ(G) subjected to the γ correction specifically means performing correction to reduce light to cancel photoexcitation by the blue stray light (subtraction processing).

Moreover, as described above, the second light-emitting profile p(G) indicates the two-dimensional distribution of the green stray light. Hence, performing the PL light correction, in accordance with the first light-emitting profile p(B) and the second light-emitting profile p(G), onto the third image signal γ(R) subjected to the γ correction specifically means performing correction to reduce light to cancel photoexcitation by the blue stray light and green stray light (subtraction processing).

As can be seen, the display device 40 can correct an image signal as a countermeasure against an effect of the green stray light and the blue stray light.

Note that, in the display device 40, the light-emitting layer, included in the light-emitting element 5B and emitting blue light, emits light by electroluminescence based on the first image signal B. The light-emitting layer, included in the light-emitting element 5G and emitting green light, emits light by: electroluminescence based on the second image signal G' subjected to adjustment; and photoluminescence with light from the light-emitting layer included in the light-emitting element 5B and emitting blue light. The light-emitting layer, included in the light-emitting element 5R and emitting red light, emits light by: electroluminescence based on the third image signal R' subjected to adjustment; photoluminescence with light from the light-emitting layer included in the light-emitting element 5B and emitting blue light; and photoluminescence with light from the light-emitting layer included in the light-emitting element 5G and emitting green light.

Third Embodiment

Described next is a third embodiment according to the disclosure, with reference to FIG. 6. A display device 50 according to this embodiment is different from the display device 30 according to the first embodiment in that the former includes a blue luminance sensor 37, and that an image signal adjustment circuit 36 can correct an image signal, reflecting an effect of a blue light component in external light. Other than that, the features of the display device 50 are the same as those of the display device 30 in the first embodiment. As a matter of convenience, identical reference signs are used to denote functionally identical components in the drawings between this embodiment and the first embodiment. Such components will not be repeatedly elaborated upon.

Figure 6:
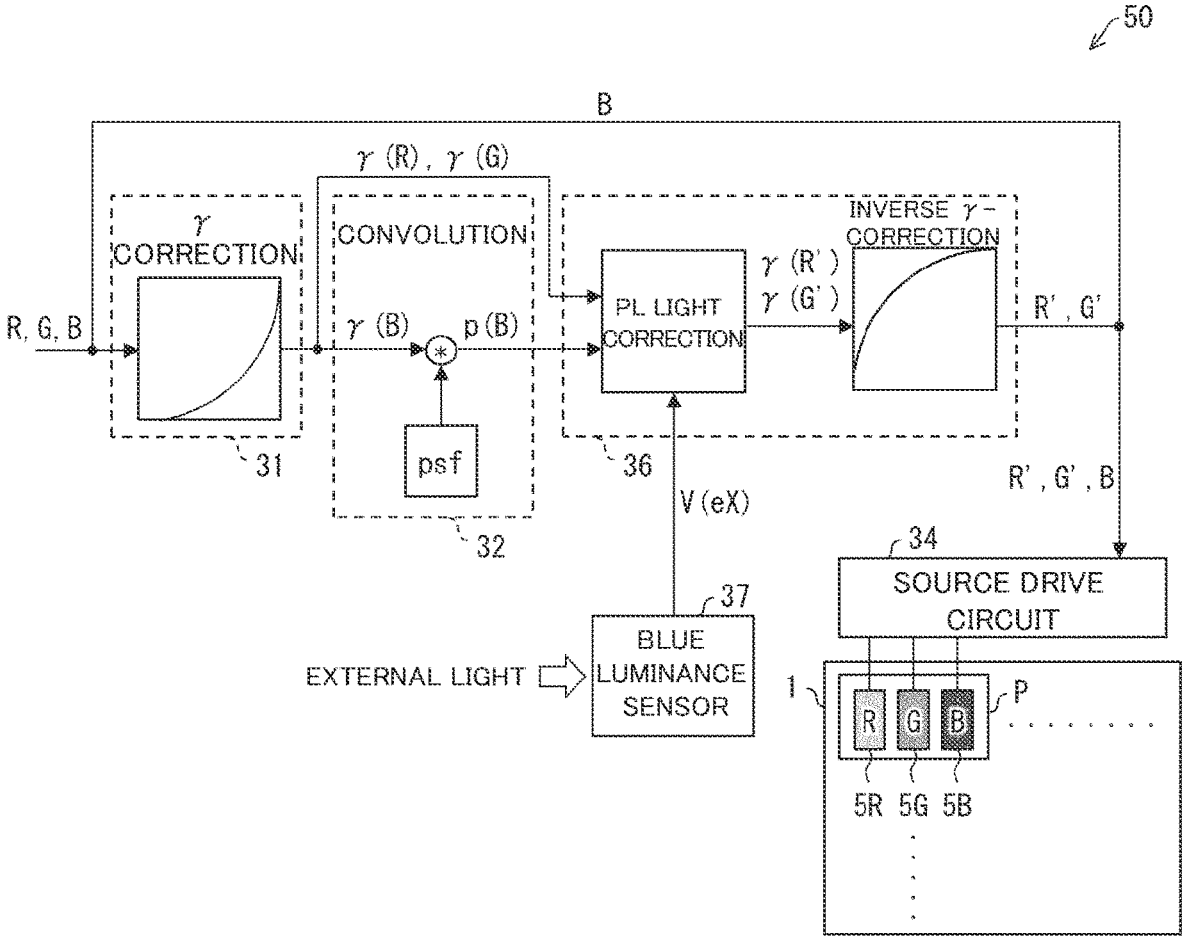
FIG. 6 is a diagram illustrating an exemplary configuration of a circuit of a display device according to a third embodiment.
Figure 7:
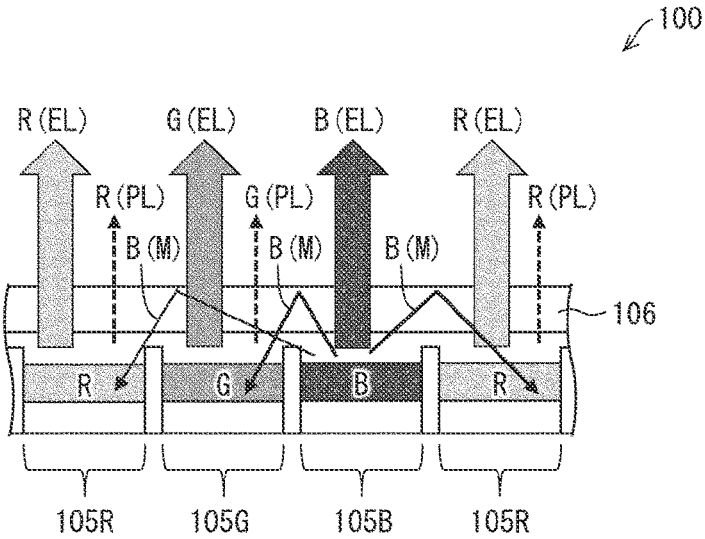
FIG. 7 is a diagram illustrating an example of a display device including QLEDs.

FIG. 6 is a diagram illustrating an exemplary configuration of a circuit of the display device 50 according to the third embodiment.

As illustrated in FIG. 6, the display device 50 includes: the display panel 1; the input image processing circuit 31; the light-emitting profile creation circuit 32; the image signal adjustment circuit 36; the blue luminance sensor 37; the source drive circuit 34; and a gate drive circuit (not shown).

The blue luminance sensor 37 obtains a blue light component in external light; that is, an intensity of a blue luminance component. The blue luminance sensor 37 can be made of a combination of, for example, a photodiode and a color filter. Note that the blue luminance sensor 37 may be provided in any given position. The blue luminance sensor 37 uses the blue light component in the external light; that is, the blue luminance component, to correct the amount of PL light emission in a sub-pixel SP glowing red and the amount of PL light emission in a sub-pixel SP glowing green. Hence, the blue luminance sensor 37 is provided preferably in the display region DA of the display panel 1, and, more preferably, near the sub-pixel PL glowing red and the sub-pixel PL glowing green. The blue luminance sensor 37 provided in the display region DA of the display pane 1 is also advantageous in view of possible reduction in the amount of light incident from outside because of an effect of a member such as a polarizer plate provided to a surface of the display panel 1.

Furthermore, in this embodiment, the external light is emitted uniformly on the display panel 1, and that is why one blue luminance sensor 37 is provided on the display panel 1. Alternatively, two or more blue luminance sensors 37 may be provided if the display panel 1 is large in size.

The blue luminance sensor 37 obtains a blue light component in external light; that is, an intensity of a blue luminance component, calculates an external light value V(eX) based on the intensity of the blue luminance component, and outputs the external light value V(eX) to the image signal adjustment circuit 36.

Note that this embodiment shows an example in which the blue luminance sensor 37 obtains the intensity of the blue luminance component and calculates the external light value V(eX) based on the intensity of the blue luminance component. However, this embodiment shall not be limited to such an example. Used instead of the blue luminance sensor 37 may be a luminance sensor capable of obtaining an intensity of external light. In such a case, the external light value V(eX) may be calculated, depending on the intensity of the external light.

Moreover, the intensity of the blue luminance component or the level of the external light value V(eX) based on the intensity of the external light can be adjusted as appropriate, depending on the necessity of correction to be performed onto the external light.

The image signal adjustment circuit 36 can obtain the second image signal γ(G') subjected to the PL light correction, in accordance with the first light-emitting profile p(B) sent from the light-emitting profile creation circuit 32, the external light value V(eX) sent from the blue luminance sensor 37, and the second image signal γ(G) sent from the input image processing circuit 31 and subjected to the γ correction. Note that γ(Gp(B)), which is the amount of PL light emission due to an effect of blue stray light in a sub-pixel SP glowing green and an effect of the blue light component in the external light, satisfies a relationship of γ(Gp(B))=α×p(B)+V(eX) (where α is a coefficient indicating a blue light excitation characteristic of the sub-pixel SP glowing green). The second image signal γ(G') subjected to the PL light correction can be obtained with Equation I below.

$$\gamma(G')=\gamma(G)-\gamma(Gp(B))=\gamma(G)-[\alpha\times p(B)+V(eX)] \quad \text{(Equation I)}$$

Likewise, the image signal adjustment circuit 36 can obtain the third image signal γ(R') subjected to the PL light correction, in accordance with the first light-emitting profile p(B) sent from the light-emitting profile creation circuit 32, the external light value V(eX) sent from the blue luminance sensor 37, and the third image signal γ(R) sent from the input image processing circuit 31 and subjected to the γ correction. Note that γ(Rp(B)), which is the amount of the PL light emission due to an effect of blue stray light in a sub-pixel SP glowing red and an effect of the blue light component in the external light, satisfies a relationship of γ(Rp(B))=β×p(B)+V(eX) (where β is a coefficient indicating a blue light excitation characteristic of the sub-pixel SP glowing red). The third image signal γ(R') subjected to the PL light correction can be obtained with Equation J below.

$$\gamma(R')=\gamma(R)-\gamma(Rp(B))=\gamma(R)-[\beta\times p(B)+V(eX)] \quad \text{(Equation J)}$$

As described above, the first light-emitting profile p(B) indicates the two-dimensional distribution of the blue stray light, and the external light value V(eX) indicates the blue light component in the external light. Hence, performing the PL light correction, in accordance with the first light-emitting profile p(B) and the external light value V(eX), onto the second image signal γ(G) and the third image signal γ(R) subjected to the γ correction specifically means performing correction to reduce light to cancel photoexcitation by the blue stray light and the blue light component in the external light (subtraction processing).

As can be seen, the display device 50 can correct an image signal as a countermeasure against an effect of the blue stray light and the blue light component in the external light.

Note that, in the display device 50, the light-emitting layer, included in the light-emitting element 5B and emitting blue light, emits light by electroluminescence based on the first image signal B. The light-emitting layer, included in the light-emitting element 5G and emitting green light, emits light by: electroluminescence based on the second image signal G' subjected to adjustment; and photoluminescence with light from the light-emitting layer included in the light-emitting element 5B and emitting blue light. The light-emitting layer, included in the light-emitting element 5R and emitting red light, emits light by: electroluminescence based on the third image signal R' subjected to adjustment; photoluminescence with light from the light-emitting layer included in the light-emitting element 5B and emitting blue light; and photoluminescence with light from the light-emitting layer included in the light-emitting element 5G and emitting green light.

Note that this embodiment shows an example in which the blue luminance sensor 37 is combined with the configuration of the above first embodiment. However, this embodiment shall not be limited to such an example. The blue luminance sensor 37 may be combined with the configuration of the above second embodiment.

SUMMARY

First Aspect

A display device includes: a first sub-pixel and a second sub-pixel, the first sub-pixel including a first light-emitting layer emitting light in a first color, the second sub-pixel including a second light-emitting layer emitting light in a second color having a wavelength longer than a wavelength of the first color, and the second light-emitting layer containing quantum dots;

a light-emitting profile creation circuit creating a first light-emitting profile of the first sub-pixel, the first light-emitting profile being created from a first image signal corresponding to the first sub-pixel; and an image signal adjustment circuit adjusting a second image signal corresponding to the second sub-pixel, the second image signal being adjusted in accordance with the first light-emitting profile.

Second Aspect

In the display device according to the first aspect, the light-emitting profile creation circuit performs a mathematical operation, based on the first image signal and a first function, and creates the first light-emitting profile.

Third Aspect

In the display device according to the second aspect, the first function is a point spread function representing a luminance distribution observed when the first sub-pixel is positioned in a center and glowing.

Fourth Aspect

In the display device according to any one of the first to third aspects, the image signal adjustment circuit performs subtraction processing onto the second image signal in accordance with the first light-emitting profile.

Fifth Aspect

The display device according to any one of the first to fourth aspects further includes a third sub-pixel.

The third sub-pixel includes a third light-emitting layer emitting light in a third color having a wavelength longer than the wavelength of the second color, the third light-emitting layer containing quantum dots.

Sixth Aspect

In the display device according to the fifth aspect, the image signal adjustment circuit adjusts a third image signal corresponding to the third sub-pixel, the third image signal being adjusted in accordance with the first light-emitting profile.

Seventh Aspect

In the display device according to the sixth aspect, the light-emitting profile creation circuit creates a second light-emitting profile of the second sub-pixel, the second light-emitting profile being created from the second image signal, and the image signal adjustment circuit adjusts the third image signal in accordance with the second light-emitting profile.

Eighth Aspect

In the display device according to the seventh aspect, the image signal adjustment circuit performs subtraction processing on the third image signal in accordance with the second light-emitting profile.

Ninth Aspect

In the display device according to the seventh or the eighth aspect, the light-emitting profile creation circuit performs a mathematical operation, based on the second image signal and a second function, and creates the second light-emitting profile.

Tenth Aspect

In the display device according to the ninth aspect, the second function is a point spread function representing a luminance distribution observed when the second sub-pixel is positioned in a center and glowing.

Eleventh Aspect

In the display device according to any one of the sixth to tenth aspects, the first color is blue, the second color is green, and the third color is red, the first light-emitting layer of the first sub-pixel emits light by electroluminescence based on the first image signal corresponding to the first sub-pixel, the second light-emitting layer of the second sub-pixel emits light by: electroluminescence based on the second image signal corresponding to the second sub-pixel and subjected to the adjustment; and photoluminescence with light from the first light-emitting layer, and the third light-emitting layer of the third sub-pixel emits light by: electroluminescence based on the third image signal corresponding to the third sub-pixel and subjected to the adjustment; photoluminescence with light from the first light-emitting layer; and photoluminescence with light from the second light-emitting layer.

Twelfth Aspect

The display device according to any one of the first to eleventh aspects further includes a luminance sensor measuring external light.

The luminance sensor measures an intensity of the external light, and the image signal adjustment circuit adjusts the second image signal in accordance with the first light-emitting profile and an external light value based on the intensity of the external light.

Thirteenth Aspect

The display device according to any one of the sixth to eleventh aspects further includes a luminance sensor measuring external light.

The luminance sensor measures an intensity of the external light, and the image signal adjustment circuit adjusts the third image signal in accordance with the first light-emitting profile and an external light value based on the intensity of the external light.

Fourteenth Aspect

In the display device according to the twelfth aspect, the image signal adjustment circuit performs subtraction processing on the second image signal in accordance with the first light-emitting profile and the external light value.

Fifteenth Aspect

In the display device according to the thirteenth aspect, the image signal adjustment circuit performs subtraction processing on the third image signal in accordance with the first light-emitting profile and the external light value.

Sixteenth Aspect

An image processing method is used for a display device including: a first sub-pixel and a second sub-pixel, the first sub-pixel including a first light-emitting layer emitting light in a first color, the second sub-pixel including a second light-emitting layer emitting light in a second color having a wavelength longer than a wavelength of the first color, and the second light-emitting layer containing quantum dots. The image processing method includes:

creating a first light-emitting profile, of the first sub-pixel, from a first image signal corresponding to the first sub-pixel; and adjusting a second image signal, corresponding to the second sub-pixel, in accordance with the first light-emitting profile.

Additional Remarks

The disclosure shall not be limited to the embodiments described above, and can be modified in various manners within the scope of claims. The technical aspects disclosed in different embodiments are to be appropriately combined together to implement another embodiment. Such an embodiment shall be included within the technical scope of the disclosure. Moreover, the technical aspects disclosed in each embodiment may be combined to achieve a new technical feature.

INDUSTRIAL APPLICABILITY

The disclosure is applicable to a display device or an image processing method.

The invention claimed is:

1. A display device, comprising:

a first sub-pixel and a second sub-pixel, the first sub-pixel including a first light-emitting layer emitting light in a first color, the second sub-pixel including a second light-emitting layer emitting light in a second color having a wavelength longer than a wavelength of the first color, and the second light-emitting layer containing quantum dots;

a light-emitting profile creation circuit configured to create a first light-emitting profile of the first sub-pixel, the first light-emitting profile being created from a first image signal corresponding to the first sub-pixel; and an image signal adjustment circuit configured to adjust a second image signal corresponding to the second sub-pixel, the second image signal being adjusted in accordance with the first light-emitting profile, wherein the light-emitting profile creation circuit is further configured to perform a mathematical operation based on the first image signal and a first function, and to create the first light-emitting profile, and the first function is a point spread function representing a luminance distribution observed when the first sub-pixel is positioned in a center and glowing.

2. The display device according to claim 1, wherein the image signal adjustment circuit is further configured to perform subtraction processing on the second image signal in accordance with the first light-emitting profile.

3. The display device according to claim 1, further comprising a third sub-pixel, wherein the third sub-pixel includes a third light-emitting layer configured to emit light in a third color having a wavelength longer than the wavelength of the second color, the third light-emitting layer containing quantum dots.

4. The display device according to claim 3, wherein the image signal adjustment circuit is further configured to adjust a third image signal corresponding to the third sub-pixel, the third image signal being adjusted in accordance with the first light-emitting profile.

5. The display device according to claim 4, wherein the light-emitting profile creation circuit is further configured to create a second light-emitting profile of the second sub-pixel, the second light-emitting profile being created from the second image signal, and the image signal adjustment circuit is further configured to adjust the third image signal in accordance with the second light-emitting profile.

6. The display device according to claim 5, wherein the image signal adjustment circuit is further configured to perform subtraction processing on the third image signal in accordance with the second light-emitting profile.

7. The display device according to claim 5, wherein the light-emitting profile creation circuit is further configured to perform a second mathematical operation based on the second image signal and a second function, and to create the second light-emitting profile.

8. The display device according to claim 7, wherein the second function is a second point spread function representing a luminance distribution observed when the second sub-pixel is positioned in a center and glowing.

9. The display device according to claim 4, wherein the first color is blue, the second color is green, and the third color is red, the first light-emitting layer of the first sub-pixel emits light by electroluminescence based on the first image signal corresponding to the first sub-pixel, the second light-emitting layer of the second sub-pixel emits light by: electroluminescence based on the second image signal corresponding to the second sub-pixel and subjected to the adjustment; and photoluminescence with light from the first light-emitting layer, and the third light-emitting layer of the third sub-pixel emits light by: electroluminescence based on the third image signal corresponding to the third sub-pixel and subjected to the adjustment; photoluminescence with light from the first light-emitting layer; and photoluminescence with light from the second light-emitting layer.

10. The display device according to claim 4, further comprising a luminance sensor configured to measure external light, wherein the luminance sensor measures an intensity of the external light, and the image signal adjustment circuit is further configured to adjust the third image signal in accordance with the first light-emitting profile and an external light value based on the intensity of the external light.

11. The display device according to claim 10, wherein the image signal adjustment circuit is further configured to perform subtraction processing on the third image signal in accordance with the first light-emitting profile and the external light value.

12. The display device according to claim 1, further comprising a luminance sensor configured to measure external light, wherein the luminance sensor measures an intensity of the external light, and the image signal adjustment circuit is further configured to adjust the second image signal in accordance with the first light-emitting profile and an external light value based on the intensity of the external light.

13. The display device according to claim 12, wherein the image signal adjustment circuit is further configured to perform subtraction processing on the second image signal in accordance with the first light-emitting profile and the external light value.

14. An image processing method that is used for a display device including:

a first sub-pixel and a second sub-pixel, the first sub-pixel including a first light-emitting layer emitting light in a first color, the second sub-pixel including a second light-emitting layer emitting light in a second color having a wavelength longer than a wavelength of the first color, and the second light-emitting layer containing quantum dots, the image processing method comprising:

creating a first light-emitting profile of the first sub-pixel from a first image signal corresponding to the first sub-pixel by performing a mathematical operation based on the first image signal and a first function; and adjusting a second image signal, corresponding to the second sub-pixel, in accordance with the first light-emitting profile, wherein the first function is a point spread function representing a luminance distribution observed when the first sub-pixel is positioned in a center and glowing.

* * * * *